US006089480A

United States Patent [19]

Rawlings

[11] Patent Number: 6,089,480

[45] Date of Patent: Jul. 18, 2000

[54] STRIKER ASSEMBLY FOR ROTARY HOG

[75] Inventor: John K Rawlings, Missoula, Mont.

[73] Assignee: Rawlings Manufacturing, Inc., Missoula, Mont.

[21] Appl. No.: 09/396,657

[22] Filed: Sep. 15, 1999

Related U.S. Application Data

[63] Continuation-in-part of application No. 09/099,264, Jun. 18, 1998, abandoned.

[51] Int. Cl.[7] ..... B02C 13/06

[52] U.S. Cl. ..... 241/73; 241/189.1

[58] Field of Search ..... 241/189.1, 197, 241/293, 294, 73, 300

[56] References Cited

U.S. PATENT DOCUMENTS

| | | | |
|---|---|---|---|
| 2,467,865 | 4/1949 | Smith | 241/197 |
| 3,642,214 | 2/1972 | Blackwell, Jr. . | |
| 3,838,826 | 10/1974 | Wallace et al. | 241/294 X |
| 4,000,860 | 1/1977 | Gothham . | |
| 4,151,959 | 5/1979 | Deister . | |
| 4,162,770 | 7/1979 | Lewis . | |
| 4,171,778 | 10/1979 | LeJeune . | |
| 4,667,713 | 5/1987 | Wright | 144/231 |
| 4,706,899 | 11/1987 | Parker et al. . | |
| 4,717,083 | 1/1988 | Quast et al. | 241/197 |
| 4,733,828 | 3/1988 | Potts | 241/294 X |
| 5,070,920 | 12/1991 | Morey . | |
| 5,100,070 | 3/1992 | Montgomery, Sr. . | |
| 5,150,844 | 9/1992 | McKie . | |
| 5,165,611 | 11/1992 | Ragnarsson . | |
| 5,183,089 | 2/1993 | Norlander et al. | 144/231 |
| 5,211,212 | 5/1993 | Carlson et al. . | |
| 5,269,355 | 12/1993 | Bowen . | |
| 5,273,218 | 12/1993 | Burns . | |
| 5,285,974 | 2/1994 | Cesarini | 241/197 X |
| 5,320,292 | 6/1994 | Smith . | |
| 5,529,249 | 6/1996 | Braun et al. | 241/300 X |
| 5,647,419 | 7/1997 | Stewart . | |
| 5,649,668 | 7/1997 | Steinberg . | |
| 5,713,525 | 2/1998 | Morey . | |

FOREIGN PATENT DOCUMENTS

| | | | |
|---|---|---|---|
| 704659 | 12/1979 | Russian Federation | 241/197 |
| 489678 | 8/1938 | United Kingdom . | |
| 215 3704 | 8/1985 | United Kingdom . | |
| 2153704A | 8/1985 | United Kingdom | 241/197 |

*Primary Examiner*—David A. Scherbel
*Assistant Examiner*—Anthony Ojini
*Attorney, Agent, or Firm*—Dowrey & Associates

[57] ABSTRACT

A striker assembly for attachment to the rotor lobe of a rotary hog for impact fragmentation, cutting and shearing action. The striker assembly includes a striker plate having a body portion attachable to the rotor lobe by means of screwthreaded connectors with the top portion of the striker plate extending radially beyond the rotor periphery. The striker plate has an offset ledge for receiving one or more striker bits which are clamped thereto by appropriate bolts and which include protrusions on the rear face thereof in engagement with mating recesses in the striker plate face. Each striker bit is symmetrical around a central longitudinal plane with opposed cutting edges running the length of the bit. The bit is removable and may be rotated 180° allowing alternate use of the cutting edges. The bit includes forward faces adjacent the cutting edges which are disposed at an angle to the front and rear faces of the bit so as to provide an aggressive cutting edge. When mounted on the striker plate, and depending upon the orientation of the striker plate, a rake angle of 0°–25° is formed. In one embodiment, the striker plate is wedge shaped for disposing the cutting edges of the striker bits at an angle relative to the rotational axis of the rotor to exert a shearing action on the material before impact with an anvil.

20 Claims, 5 Drawing Sheets

STRIKER ASSEMBLY FOR ROTARY HOG

CROSS REFERENCE TO RELATED APPLICATION

This Application is a Continuation-in-part of my copending application Ser. No. 09/099,264 filed Jun. 18, 1998.

BACKGROUND OF THE INVENTION

1. Field of the Invention

The present invention relates to apparatus for performing a plurality of size reducing actions including impact fragmentation, cutting and shearing by means of an impact rotor mounted for rotation within a reduction chamber. More particularly, the present invention relates to the impact striker assembly carried by the lobes of a rotor which cooperate with a stationary anvil or wear surface and a grate to perform cutting and shearing action of the type described in U.S. Pat. No. 5,150,844 to McKie, especially the embodiment of FIG. 8 therein, the disclosure of which is included herein by reference.

2. Description of the Prior Art

Typical prior art heavy duty material reduction apparatus utilizing impact rotors of the type under consideration are disclosed in U.S. Pat. No. 4,151,959 to Deister and U.S. Pat. No. 5,150,844 to McKie. These patents are illustrative of the prior art utilizing either a radially attached, axially or helically extending cutter bar or striker plate. The McKie patent, for instance, illustrates a cutter bar extending axially on the surface of a rotating drum for direct impact cutting in cooperation with an anvil, hardened wear surface or grating. The cutter bar is also shown with multiple removable striker plates mounted thereon for contact with an anvil or other surface. The Deister patent illustrates still another type of impact rotor comprised of a series of rotary segments with offset, radially extending lobes for mounting removable striker plates. In both types of apparatus, the cutter bar or an attached striker plate includes a leading hardened cutting edge subject to severe wear and deterioration because of the high impact loads experienced during material processing. The cutter bar or striker plates may be symmetrical so as to include two cutting edges with the striker plate or cutter bar being capable of reversal or turning to utilize a second cutter edge. Whether the cutter bar or striker plate is unitary or segmented, it is necessary to completely remove the plate or bar assembly from the rotor in order to replace a cutting edge or to reverse the position of the cutter bar or striker plate. In heavy duty rotary hogs this operation is not only expensive and time consuming but requires access to the massive rotor element under hazardous working conditions.

Although other types of cutter bars striker plates and removable cutting edges have been proposed, either the entire striker plate or cutter must be removed for reworking or the complexity of the attachment means for removable cutting elements precludes their use in heavy duty crushers and rotary hogs. For instance, there is a need for replaceable cutting tools or bits which may be removed by easily accessible bolts without requiring lateral movement of the parts. The cutting tool or bit and striker plate must at the same time be configured for simplicity and maximum ruggedness in order to withstand the extremely high impact pressures without fracturing. The attaching means must be arranged so as not to interfere with the material processing and require no particular special skills to manipulate.

SUMMARY OF THE INVENTION

The present invention provides an impact striker assembly including a striker plate adapted for attachment directly to the radially extending rotor lobe of a heavy duty, size reducing apparatus commonly known as a rotary hog. The striker plate bits or cutting tools are attached as inserts to the striker plate and may be adapted for use with either a single cutter bar or segmented rotors most commonly used in the art. The inserts obviate the necessity of removal of striker plates or cutter bars for reworking the hard cutting edge surface. Either single or multiple replaceable striker bits may be used for any particular striker plate as a matter of choice or design. Each striker bit or tool insert is symmetrical about a central longitudinal plane passing through the bit so that it may be easily removed, rotated 180° and remounted on the striker plate without removing the striker plate itself. The striker plate configuration is adaptable for use with most designs of rotors having radial lobes for that purpose. Each striker bit is mounted directly to the top edge of the striker plate, projects forwardly and presents a cutting edge and face which is inclined forwardly from the front face of the striker plate to present an aggressive rake angle with the radial line through the axis of the rotor in the direction of rotation of the rotor. Each striker bit is formed with a central longitudinal recessed channel adapted for reception of retaining bolts and includes protrusions on the back side thereof which interfit with matching recesses in the top edge of the striker plate to enhance the positioning and retention of the bit on the face of the plate. With the top edge of the striker plate extending radially beyond the rotor lobe, easy access is provided for mounting and removing the bits from the striker plate thus alleviating any problem of access for removal and/or rotation of the bits. With this structure, one or more of the bits may be rotated or replaced in a fraction of the time it normally takes to remove the entire striker plate structure as is commonly done at present with existing structures. Since the striker bits are moved forwardly off of the face of the striker plate, requiring no vertical or sideways shifting, individual bits in a series may be removed if necessary with no problem of accessibility and without disturbing adjacent bits or striker plates.

In one embodiment of the invention, the striker plate is constructed with a wedge shaped body in its longitudinal direction, i.e. in the direction of the axis of the rotor, for the purpose of orienting the striker bit mounting face and hence the cutting edges and faces of the striker bits at an angle with respect to the rotor axis. The striker plates may thus be utilized on rotor lobes having front mounting faces extending in an axial direction relative to the rotor axis for the purpose of obtaining additional shearing action on the material to be reduced. Providing a cutting or shearing angle in the range 0°–20° on the cutting edges of the striker assemblies, in this case the cutting edges of the striker bits, causes the edges to bite into the material with a shearing action rather than merely a crushing action against the anvil. It would also be possible to utilize the wedge shaped striker plates to adjust or change an existing angle of the lobe mounting face. The striker plates may be angled in either direction i.e. the thickness of the wedge shaped body may be increasing or decreasing from right to left relative to the rotor axis, depending upon the design of the particular material reduction equipment. Since the cutting action occurs prior to the crushing of the material against the anvil, the "surge" effect experienced with some crushing machines may be alleviated.

DESCRIPTION OF THE PREFERRED EMBODIMENT

Figure 1:
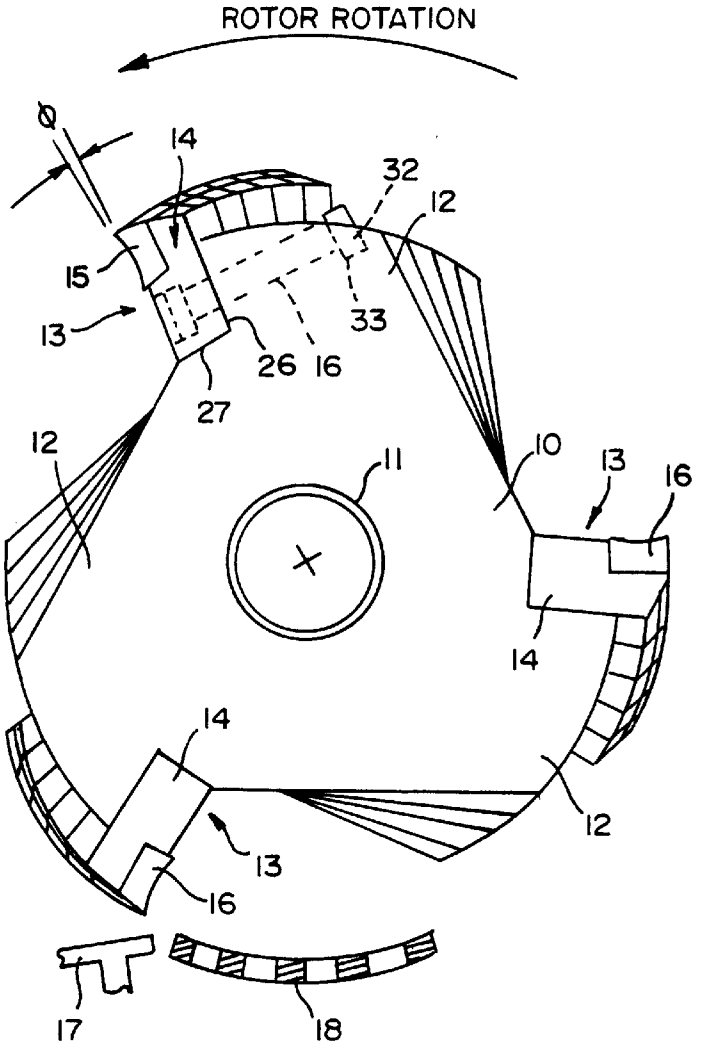
FIG. 1 is a side elevational view of a rotor equipped with the striker assembly of the present invention.

FIG. 1 illustrates a typical rotor for a material size reduction processing apparatus such as a rotary hog. The rotor body 10 illustrated is constructed of solid cast metal but it will be understood that the present invention is equally applicable to any rotor configuration whether solid or drum type having a striker plate mounting surface. In most installations, such as used for reduction of wood, fiber and mixed material, the rotor 10 is carried on a motor driven shaft 11 for high speed rotation of the cutters within a closed chamber. The rotor 10 is a massive structure weighing several tons, depending upon the width and diameter of the rotor. The illustrated rotor is of the segmented type wherein successive lobed segments extend axially along the shaft 11. Each successive segment is circumferentially offset in the direction of rotation indicated by the arrow in FIG. 1, forming a stepped row of striker mounting faces in a helical pattern along the axis of the shaft 11. In practice it is customary to offset the lobes in the order of 15°–20° of circular rotation. This arrangement is illustrated as being typical and it will be understood that many variations of this configuration are available in the art. Although variable, depending on the particular rotor design, each lobe segment 12 may range in width from ½–13 inches with a typical rotor having a width in the neighborhood of approximately 12 inches in the axial direction, the illustrated rotor typically having a total nominal width of 48 inches.

As illustrated in FIG. 1, each rotor lobe 12 is provided with a striker assembly indicated generally at 13, which includes a striker plate 14, a striker bit 15 and threaded connectors or bolts 16 connecting the striker plate to the face of the rotor lobe 12. The closed reduction chamber will also include an anvil means 17 and a grate 18 shown schematically in FIG. 1. The configuration, positioning and functioning of the anvil and grate structures and their cooperation with the striker plate assembly is well known and understood by those familiar with the art.

Figure 4:
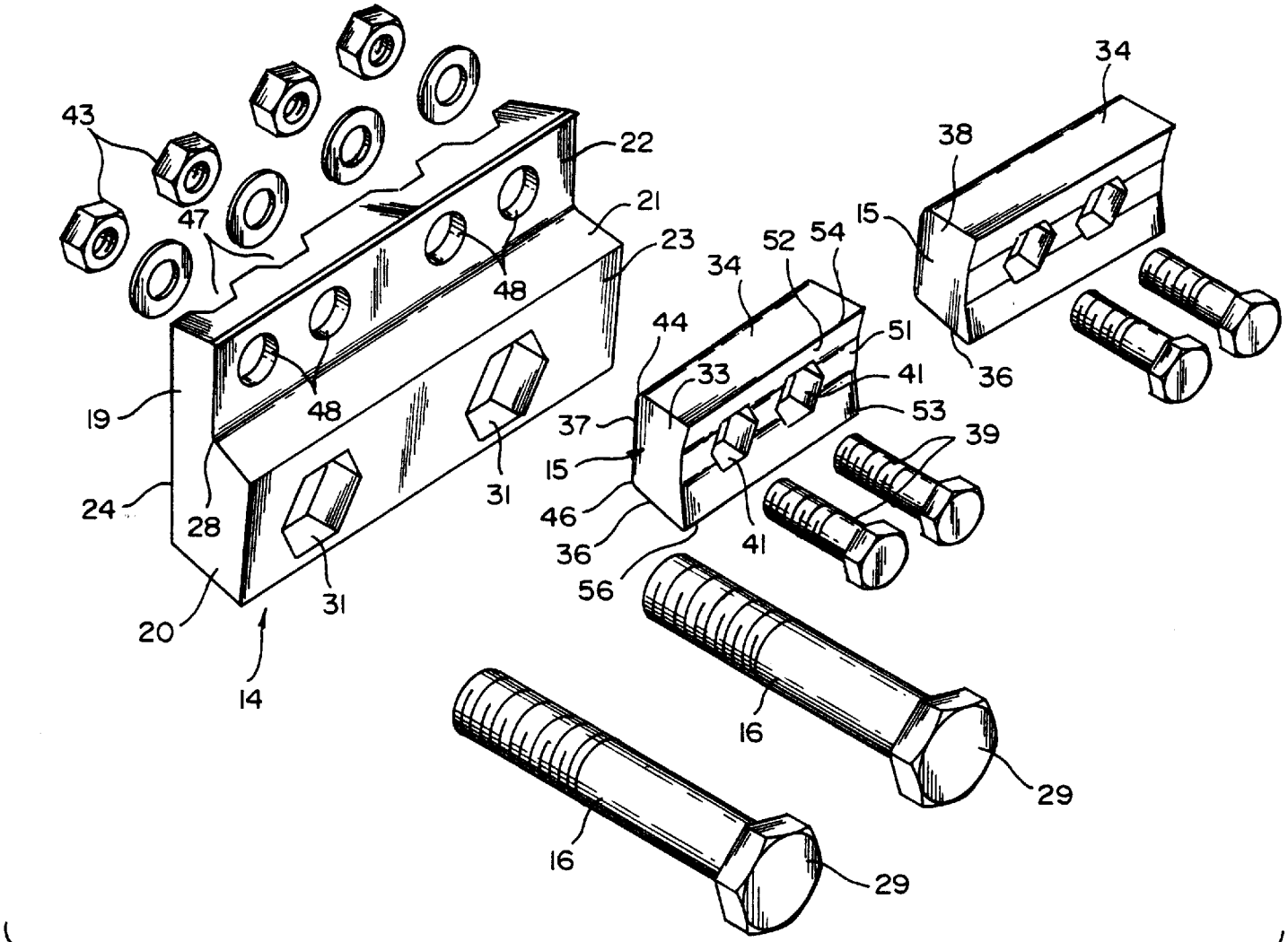
FIG. 4 is an exploded perspective view illustrating the method of attachment of the bits to the striker plate as well as the connection between the striker plate and the rotor lobe.

FIG. 4 is an exploded elevational view illustrating structural details of the striker plate, striker bits and threaded connectors. Each striker plate 14 is designed to extend the width of an associated rotor lobe and may be constructed from solid steel with an upper body portion 19 and a lower body portion 20 of increased thickness. The lower body portion forms an offset ledge or recess having a bottom surface 21 and a front face 22 for receiving the removable bits presently to be described. For this purpose, the surface 21 is disposed at an obtuse angle relative to the face 22. The body of the striker plate also includes a lower front face 23 and a rear face 24 for cooperation with the rotor lobe. Each lobe 12 of the rotor is provided with a planar front mounting face 26 and a bottom surface 27 at right angles thereto designed to receive the striker plate with the rear face 24 of the striker plate in full face engagement with the front face 26 of the lobe as shown in FIG. 1. It will also be noted, as shown in FIG. 4, that the junction between the front face 22 and the bottom surface 21 of the recess in the striker plate is provided with a radius as shown at 28 to eliminate any weakness or fracture line in the body of the striker plate.

As aforementioned, each striker plate is provided with connectors for clamping the striker plate to the front face of the associated rotor lobe. In the illustrated embodiment, the connectors comprise two mounting bolts 16 which extend through the body of the striker plate, as shown in FIG. 1, the hex heads 29 of each of the bolts 16 being received by suitable matching recesses 31 in the face 23 of the striker plate. As also illustrated in FIG. 1, the bolts 16 extend through suitable bores in the lobes 12 and are provided with nuts 32 located in suitable recesses 33 on the top surface of lobes 12. With this arrangement, the striker plates 14 are solidly clamped against the face of the lobes with sufficient torque applied to the bolts to ensure a solid connection capable of withstanding the severe impact pressures encountered during the cutting action. Although only two connector bolts 16 have been illustrated, it will be understood that the invention is not so limited and the assembly could include any number of bolts, some installations requiring up to seven or more connectors.

Figure 5:
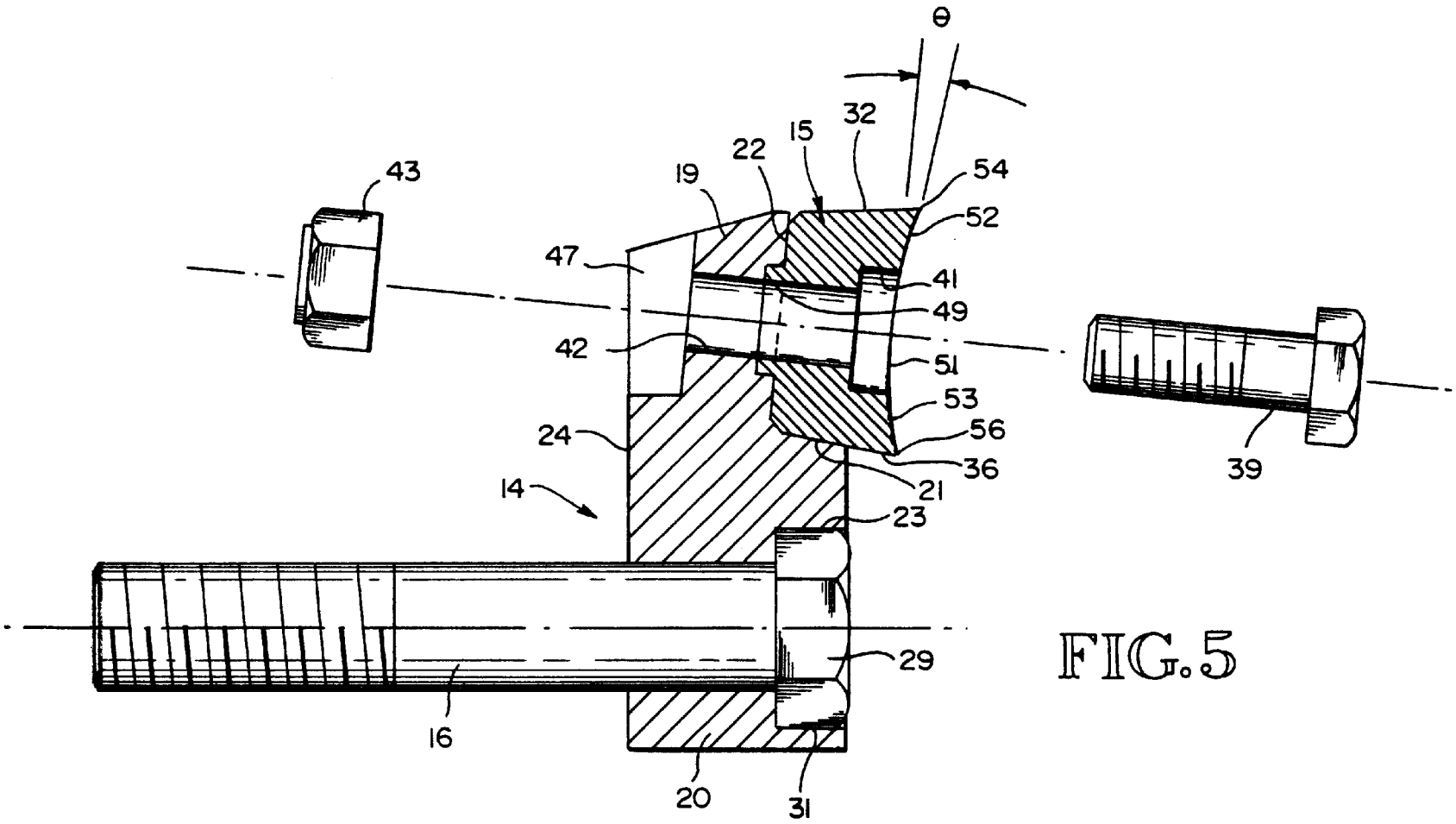
FIG. 5 is a cross sectional view of the striker assembly.

Details of the striker bits 15 are shown most clearly in FIGS. 4 and 5 with each bit comprising a generally rectangular solid steel body with longitudinal cutting edges having appropriately hardened surfaces as will presently be described. The present illustrated embodiment utilizes two such striker bits assembled side-by-side on a single striker plate with the bits being identical in all respects and thus interchangeable. For this reason the description of only one such bit will suffice. Although the present preferred embodiment illustrates the use of two bits for each striker plate, it will be understood, of course, that a single bit may be used or, in the alternative, more than two bits may be mounted on one striker plate, depending upon the desired rotor design. The bit body includes top and bottom opposing planar surfaces 34 and 36 respectively which extend in converging planes in the direction of the striker plate as illustrated most clearly in FIG. 5. The bit body also includes a rear face 37 adapted to engage the front face 22 of the striker plate as shown in cross section in FIG. 5. The end faces 38 of the bit are also planar in order to allow the bits to be assembled in end-to-end relation with no substantial break on the striker plate. The bits are held in position in the recess of the striker plate by means of the hex head retention bolts 39 which pass through suitable bores in the bit. In the illustrated embodiment, the bolt heads are located in the recesses 41 in the bit face but it will be understood that the bolts may be used either with or without the recesses. The bolts 39 are received in suitable bores 42 in the upper body portion 19 of the striker plate and secured by hex head nuts 43 as illustrated. The top and bottom rear edges 44 and 46 of the bits will be configured to conform to the face of the striker plate.

As seen most clearly in FIG. 1, the upper body portion 19 of the striker plate extends above the rotor surface and the rear face 24 of the plate is provided with semi circular recesses 47. The recesses 47 open upwardly into the top surface of the back edge of the striker plate giving easy access for removal of the nuts 43 and to facilitate clean-out of the area around the nuts which may accumulate debris during operation of the rotor. The bores 42 in the striker plate include enlarged diameter surface recesses 48 in the face 22 for reception of mating circular protrusions 49 on the back face 37 of the bits. These protrusions and recesses insure proper indexing of the bits and aid in preventing vertical or lateral movement of the bits relative to the striker plate once in place.

The front face of each bit comprises a central longitudinal surface 51 with opposite forwardly inclined parallel cutting edge surfaces 52 and 53 on either side thereof. The surfaces 52 and 53 are inclined outwardly from the center area 51 with the intersection of the surfaces 52 and 53 with the top and bottom surfaces 34 and 36 respectively of the bit body forming cutting edges 54 and 56 respectively. As seen in FIGS. 1 and 5 the surface 52 is inclined forwardly from the planes of the front and rear surfaces of the bit at an angle $\Theta$ which may be in the neighborhood of approximately 0°–10°. In this respect, it will also be noted that the front face 22 of the upper portion of the striker plate body may be inclined forwardly with the respect to the rear surface 24. With the striker plate installed on the rotor lobe as illustrated in FIG. 1, the forward inclination of the cutting edge surface of the bit will produce a rake angle $\phi$ of from 0°–25° with a radial line through the center of the rotor in the direction of rotation. The amount of rake angle will, of course, depend upon the orientation of the striker plate as it engages the face of the lobe 12. The rake angle described has been found to be extremely advantageous and produces an aggressive cutting action in cooperation with an anvil or grate.

Figure 2:
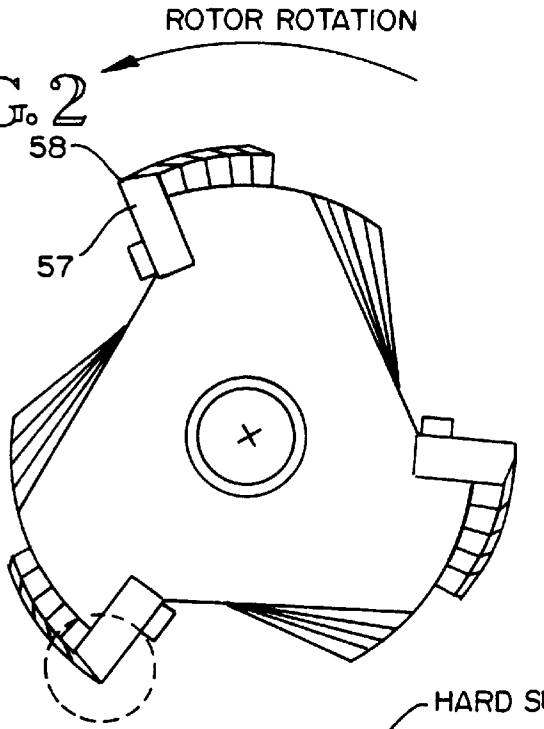
FIG. 2 is a side elevational view of the standard prior art rotor with conventional striker plates.
Figure 3:
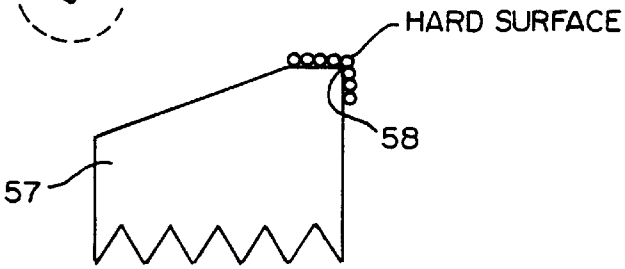
FIG. 3 PRIOR ART
FIG. 3 is a detail view of the dotted line circled portion in FIG. 2.

In practice, each striker plate 14 is initially provided with one or more bits 15 having hardened cutting edges which function in conjunction with the anvil and the grate to perform the impact fragmentation, cutting and shearing within the reduction chamber. When the original cutting edges become worn and need replacing, it is only necessary to remove the bolts 39, rotate the bits 180° and reclamp them on the striker plate and the rotor is ready for operation. When both surfaces of the bit are worn, the bit may be replaced by another and the original cutting edges of the worn bit reworked. This operation is contrasted to the present practice indicated in FIGS. 2 and 3 wherein the rotor lobes are provided with striker plates 57 suitably clamped to the face of the associated lobe in the manner described. Each striker plate has a forward cutting surface and edge 58 having a hard surface material such as a welded tungsten carbide beads or equivalent hard surface coating laid on the cutting surface as shown in FIG. 3. When the edge 58 and hard surface become worn, it is necessary to remove the entire striker plate 57, replace the hard surface coating along the edge and then replace the striker ready for reuse. Because of the size of striker plates, the removal of the connecting long bolts, the necessity of reworking the cutting edge of the striker and then replacing the whole assembly, many man hours are spent periodically reworking the striker plate edges. In addition, this operation must be carried on with the rotor in place within the reduction chamber presenting work space limitations and the danger of working with the massive elements in a restricted space. The removal and replacement of old style strikers requires special tooling and a minimum of two men to perform the operation. One man may easily remove the smaller connecting bolts of the striker bits of the present invention and replace them or rotate them in a fraction of the time that it takes to replace the entire striker plate assembly.

Figure 6:
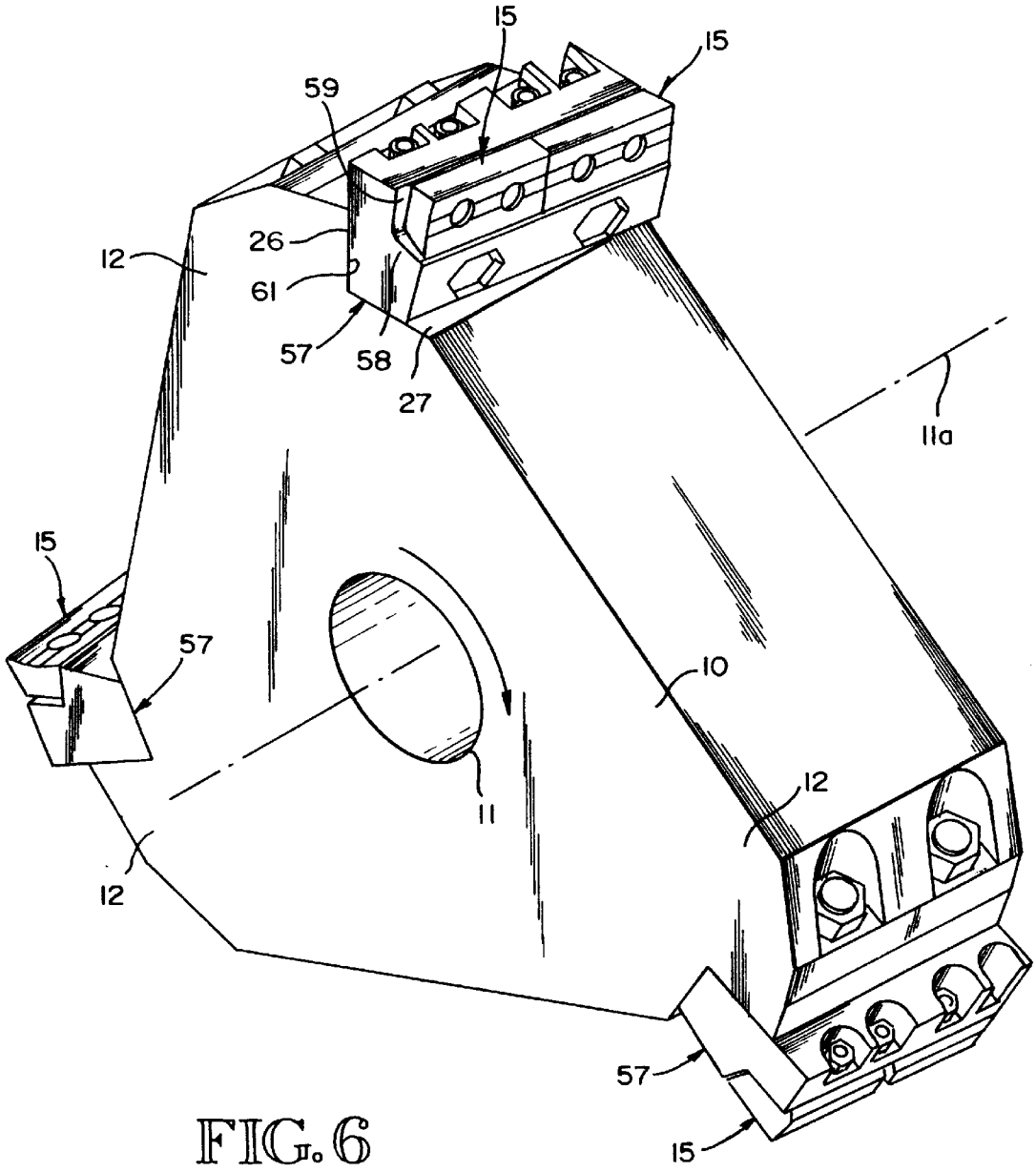
FIG. 6 is a perspective view of a rotor section with angled striker plates of a second embodiment.

FIG. 6 illustrates a second embodiment of the striker assembly constructed in a fashion to provide a cutting or shearing angle for the striker plate and, in the present embodiment, the cutting edges and cutting faces of the striker bits relative to the rotational axis of the rotor. The rotor section 10 in FIG. 6 is illustrative of a well known rotor segment design and may be understood to be the same construction, in all respects, as described for the rotor 10 in FIG. 1, including its mounting on the power driven shaft 11 having an axis of rotation 11*a*. As described relative to the FIG. 1 embodiment, each lobe 12 is provided with a planar front mounting face 26 and a bottom surface 27 at right angles thereto designed to receive a striker assembly. It is noted that the mounting face 26 in the embodiment shown is located in a plane either parallel to or passing through the center line of the rotor. With this design, if a cutting edge is located parallel to the mounting face 26, the reducing action is primarily one of crushing between the striker assembly or other cutting edge or surface and the anvil. Very little if any shearing or cutting is accomplished at any other location in the path of the rotor. This results naturally in a "surging" of the material being crushed although the device is subject a continuous feeding process.

According to the present embodiment, the novel striker plate 57 includes an offset ledge or recess having a bottom surface 58 and a front face 59 for receiving the removable striker bits 15 which may be identical to those described relative to the FIGS. 1–5 embodiment and may be mounted to the striker plate 57 in the same manner as previously described. The striker plate 57 includes a bottom surface for contacting the surface 27 of the offset in the lobe 12 and a rear planar face 61 for contacting the front face 26 of the lobe 12. The mounting connection between the striker plate 57 and the rotor lobe 12 may be in all respects identical to that previously described for FIGS. 1–5 embodiment.

Figure 7:
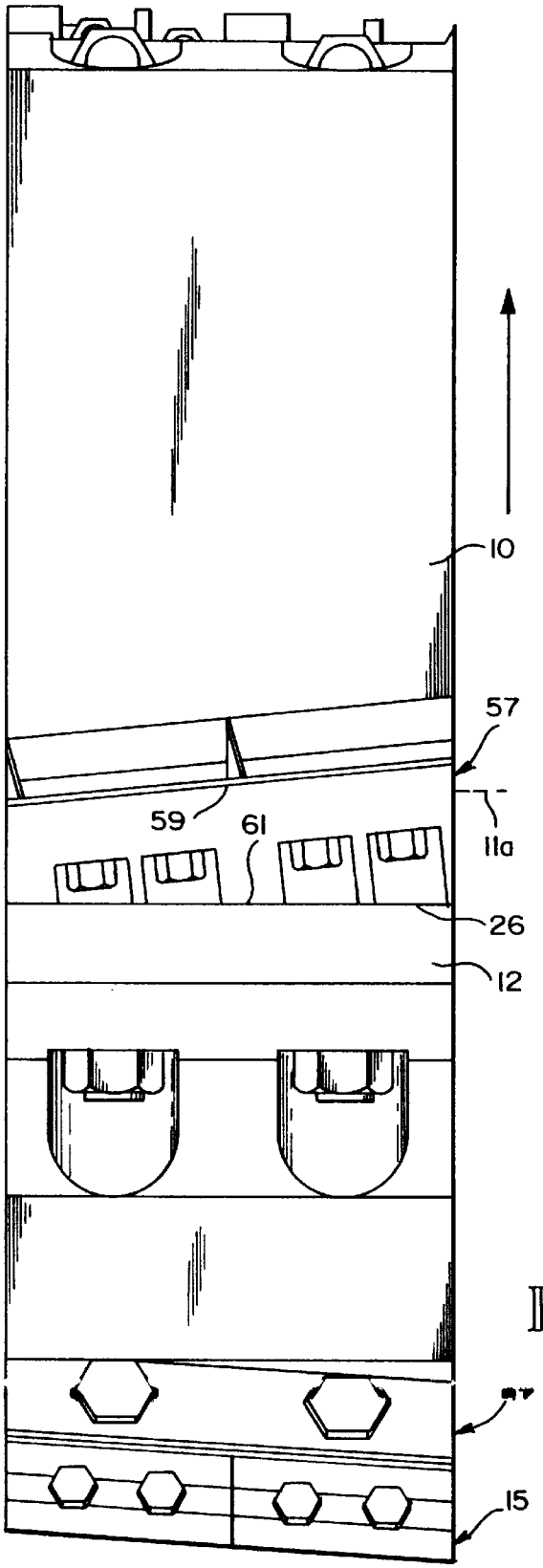
FIG. 7 is a top plan view of the second embodiment of the striker assembly having the striker plate angled in the opposite direction from that illustrated in FIG. 6.
Figure 8:
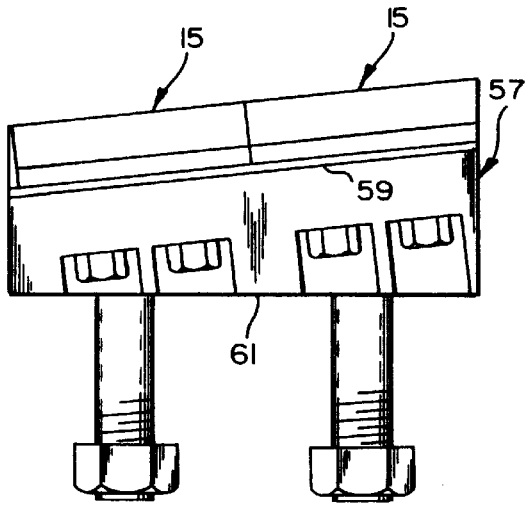
FIG. 8 is a top plan view of an angled striker assembly of the type shown in FIG. 7.

As seen most clearly in FIGS. 7 and 8, when viewed in plan, the striker plate 57 has a tapered or wedge shaped body with the general plane of the rear face 61 being disposed at an angle to the striker bit mounting face 59. With the striker plate mounted in position on the lobe 12, and with the mounting face 26 of the lobe being in a plane parallel to the axis of rotation 11*a*, the striker bits 15 and the front mounting face 59 are disposed at a cutting angle relative to the axis 11*a*. Thus when the rotor is traveling in the direction of the arrow in FIG. 7, the cutting edges and faces of the bits 15 create a shear force on the material being reduced as the rotor moves, allowing the cutting edge to bite into the material even prior to contact with the anvil. The striker assembly performs like a blade using shear force to reduce the material before crushing it against the anvil. In practice, the angle of the cutting edges of the striker bits relative to the axis of rotation may range from 0°–20°. It will also be readily apparent that the cutting edge may be angled forwardly in the direction of rotation in either direction from the axis of rotation. The mounting in FIGS. 7 and 8 illustrates an angle directed forwardly in the right hand direction relative to the direction of rotation of the rotor; while the mounting in FIG. 6 depicts a left hand directed angle. The direction of the angle of the cutting edge will depend upon the design desired for any given rotor.

By cutting rather than merely crushing the material to be reduced, the present invention is able to handle larger volumes of material without the surging effect experienced with other designs. The surging effect results when the material to be reduced is crushed between the striker and the anvil since the material must be sufficiently reduced before more material can be accepted. Since the rotary hog is normally fed by constant feeder means, the surging effect results with the axially aligned strikers performing more in the nature of paddles than blades. With the present striker assembly, the resulting shear force reduces the material before it is crushed against the anvil enabling more effective reduction and a more continuous material flow.

Although the present invention has been disclosed as used with rotor lobe mounting faces in a plane generally parallel to the rotor axis, striker plates of the present configuration may be used to increase or decrease existing angled striker faces. It will also be understood that the combination of the aggressive rake angle of the cutting edge as previously described along with the shear angle of the striker bit cutting edges improves the effective reduction of the material.

It is to be understood that the foregoing description and accompanying drawings have been given by way of illustration and example. It is also to be understood that changes in form of the several parts, substitution of equivalent elements and arrangement of parts which will be readily apparent to one skilled in the art are contemplated as within the scope of the present invention, which is limited only by the claims which follow.

What is claimed is:

1. A striker plate assembly for an impact rotor comprising;

a striker plate having a rear face for attachment to a rotor and a front working face, said working face including a longitudinal recess, at least one striker bit configured to be received in said recess and including front and rear surfaces in the direction of rotation, connector means extending through said bit and said striker plate for clamping said bit in said recess, at least one mating protrusion and recess on the rear surface of said bit and said striker plate recess immediately surrounding said connector means for positively positioning said bit in said recess while permitting removal of said bit from the striker without relative lateral movement, said bit being generally rectangular in longitudinal cross section and symmetrical about a central longitudinal plane at right angles to its rear surface, said bit having opposed longitudinally extending cutting faces on its front surface inclined outwardly therefrom in the direction of rotation and terminating in first and second cutting edges, said cutting faces and said cutting edges extending the full length of said bit, whereby said bit may be removed by lifting the same away from said recess, rotated 180° and then replaced to alternately utilize said first and second cutting edges.

2. The striker plate assembly of claim 1, wherein;

said striker plate is wedge shaped with the general plane of the rear face thereof located at a shear angle in the transverse direction relative to the general plane of its working face, whereby the cutting edge of said at least one striker bit, when carried on an impact rotor, may be disposed at a cutting angle relative to the rotor axis.

3. The striker plate assembly of claim 2 wherein said shear angle ranges from 0°–30°.

4. A striker plate assembly for an impact rotor comprising;

a striker plate having a rear face for attachment to a rotor and a front working face, said working face including a longitudinal recess with a mounting face inclined forwardly in the direction of rotation, at least one striker bit configured to be received in said recess and including front and rear surfaces in the direction of rotation, said front surface extending forwardly beyond the working face of said striker plate, at least one mating protrusion and recess on the rear surface of said bit and said striker plate recess for positively positioning said bit in said recess, at least one threaded connector, said connector extending through the bit and striker plate and having a multifaceted head received in said bit with a screwthreaded keeper on the opposite end thereof for clamping said bit to the striker mounting face, a recess on the rear face of said striker for receiving said screwthreaded keeper, said recess opening into the top surface of the striker plate to facilitate access to said keeper and removal of debris, said bit being generally rectangular in longitudinal cross section and symmetrical about a central longitudinal plane at right angles to its rear surface, said bit having opposed longitudinally extending cutting faces on its front surface inclined outwardly at an angle of 0°–10° with the rear surface of the bit in the direction of rotation and terminating in first and second cutting edges, said cutting faces and said cutting edges extending the full length of said bit, whereby said bit may be removed, rotated 180° and then replaced to alternately utilize said first and second cutting edges.

5. The striker assembly of claim 4 wherein said protrusion comprises a cylindrical extension on the rear surface of said bit surrounding said connector and said recesses comprises a matching cylindrical recess surrounding said connector in the striker plate mounting face.

6. The striker assembly of claim 5 including a plurality of said bits assembled end-to-end in said striker plate recess, each said bits including a plurality of said screwthreaded connectors.

7. The striker plate of claim 4 wherein;

said striker plate is wedge shaped with the general plane of the rear face thereof located at a shear angle in the transverse direction relative to the general plane of its working face, whereby the cutting edge of said at least one striker bit, when carried on an impact rotor, may be disposed at a cutting angle relative to the rotor axis.

8. The striker plate of claim 7 wherein said shear angle ranges from 0°–30°.

9. In a rotary material breaker having a rotor with at least one radially extending lobe, said lobe including a forwardly disposed mounting face in the direction of rotation, an impact striker assembly comprising;

a striker plate, said striker plate having a rear face adapted to engage said lobe mounting face, at least one threaded connector extending through the striker plate and said lobe and having a multifaceted head recessed in said striker plate with a screwthreaded keeper on the opposite end thereof for clamping said striker plate to said lobe, said striker plate having an upper portion thereof extending radially beyond said lobe and including a longitudinal recess therein, said recess having a forwardly disposed striker mounting face inclined in the direction of rotation, at least one striker bit configured to be received in said recess, at least one mating protrusion and recess on the rear face of said bit and striker mounting face for positively positioning said bit in said striker plate recess, said bit having top and bottom surfaces and a rear face adapted to contact the striker mounting face of said recess and at least one threaded connector for clamping said bit to the striker mounting face, said threaded connector extending through the bit and said striker plate having a multifaceted head recessed in said bit with a screwthreaded keeper on the opposite end thereof, a recess on the rear face of said striker plate for receiving said screwthreaded keeper, said recess opening into the top surface of the striker plate to facilitate access to said keeper and removal of debris, said bit being generally rectangular in longitudinal cross section and symmetrical about a plane passing through it s central longitudinal axis and at right angles to its rear face, said bit having a forward face extending forwardly beyond the striker plate with a central longitudinal surface and opposed longitudinally extending cutting faces inclined outwardly therefrom in the direction of rotation forming a rake angle of 0°–25° and terminating in first and second cutting edges associated with the tip and bottom surfaces of the bit, said cutting faces and associated cutting edges extending the full length of said bit, whereby said bit may be removed, rotated 180° and then replaced to alternately utilize said first and second cutting edges.

10. The striker assembly of claim 9 wherein said mating protrusion and recess comprise;

a cylindrical protrusion on the rear face of said bit surrounding said connector, and a matching cylindrical recess surrounding said connector in the striker plate mounting face for positively positioning said bit in the striker plate recess.

11. The striker plate assembly of claim 10 including a plurality of said bits assembled end-to-end in said striker plate recess, each said bits including a plurality of said screwthreaded connectors.

12. The apparatus of claim 5 wherein;

said striker plate is wedge shaped with the general plane of the rear face thereof located at a shear angle in the transverse direction to the general plane of said striker mounting face, whereby the cutting edges of said at least one bit are disposed at a cutting angle relative to the axis of said rotor.

13. The apparatus of claim 12 wherein said shear angle ranges from 0°–30°.

14. A striker plate assembly for an impact rotor comprising;

a striker plate having a rear face for attachment to a rotor and a front working face, said working face including a longitudinal recess, at least one striker bit configured to be received in said recess and including front and rear surfaces in the direction of rotation, connector means extending through said bit and said striker plate for clamping said bit in said recess, at least one mating protrusion and recess on the rear surface of said bit and said striker plate recess for positively positioning said bit in said recess, said bit having a transversely extending cutting edge, said striker plate being wedge shaped with the general plane of its rear face located at a shear angle in the transverse direction relative to the general plane of its working face, whereby the cutting edge of said bit, when carried on an impact rotor, may be disposed at a cutting angle relative to the rotor axis.

15. The striker plate assembly of claim 14 wherein said cutting angle ranges from 0°–30°.

16. The striker plate assembly of claim 15 wherein said mating protrusion and recess immediately surrounds said connector means and permits removal of said bit from the striker without lateral movement.

17. The striker plate assembly of claim 16 wherein said bit is generally rectangular in longitudinal cross section and symmetrical about a central longitudinal plane at right angles to its rear surface, said bit including;

opposed longitudinally extending cutting faces on its front surface terminating in first and second cutting edges, whereby said bit may be removed by lifting the same away from said recess, rotated 180° and then replaced to alternately utilize said first and second cutting edges.

18. The striker plate assembly of claim 17 wherein said bit includes opposed longitudinally extending cutting faces on its front surface inclined outwardly therefrom in the direction of rotation terminating in said first and second cutting edges.

19. A striker plate assembly for an impact rotor comprising;

a striker plate having a transversely extending striker body with a rear face for attachment to a rotor and a front working face with means providing a transverse cutting edge thereon, said striker body being wedge shaped with the general plane of its rear face located at a shear angle in the transverse direction relative to the general plane of its working face, whereby said cutting edge may be disposed at a cutting angle relative to the rotor arms.

20. The striker plate assembly of claim 19 wherein said shear angle ranges from 0°–30°.

* * * * *

UNITED STATES PATENT AND TRADEMARK OFFICE

CERTIFICATE OF CORRECTION

PATENT NO. : 6,089,480
DATED : July 18, 2000
INVENTOR(S) : John K. Rawlings

It is certified that error appears in the above-identified patent and that said Letters Patent is hereby corrected as shown below:

Column 9,
Line 40, change "5" to -- 9 --.

Signed and Sealed this

Eleventh Day of December, 2001

*Attest:*

Nicholas P. Godici

NICHOLAS P. GODICI
*Acting Director of the United States Patent and Trademark Office*

*Attesting Officer*